US012611031B2

(12) United States Patent
Tang

(10) Patent No.: US 12,611,031 B2
(45) Date of Patent: Apr. 28, 2026

(54) STORAGE SHELF

(71) Applicant: MALZINE CO., LTD., Lukang Township, Changhua County (TW)

(72) Inventor: Pao-Hsun Tang, Lukang Township, Changhua County (TW)

(73) Assignee: MALZINE CO., LTD., Changhua County (TW)

( * ) Notice: Subject to any disclaimer, the term of this patent is extended or adjusted under 35 U.S.C. 154(b) by 0 days.

(21) Appl. No.: 18/811,712

(22) Filed: Aug. 21, 2024

(65) Prior Publication Data

US 2025/0351962 A1 Nov. 20, 2025

(30) Foreign Application Priority Data

May 16, 2024 (TW) ..... 113118181

(51) Int. Cl.

| | |
|---|---|
| ***A47B 96/02*** | (2006.01) |
| ***A47B 96/20*** | (2006.01) |
| *A47B 47/00* | (2006.01) |
| *A47B 47/02* | (2006.01) |
| *A47B 57/06* | (2006.01) |

(52) U.S. Cl.

CPC ..... *A47B 96/021* (2013.01); *A47B 96/201* (2013.01); *A47B 47/0083* (2013.01); *A47B 47/021* (2013.01); *A47B 57/06* (2013.01)

(58) Field of Classification Search

CPC ..... A47B 96/021; A47B 96/201; A47B 47/00; A47B 47/0008; A47B 47/0083; A47B 47/021; A47B 47/045; A47B 57/06; A47B 57/30; A47B 87/02; A47B 87/0207

See application file for complete search history.

(56) References Cited

U.S. PATENT DOCUMENTS

| | | | | | |
|---|---|---|---|---|---|
| 2,219,595 | A * | 10/1940 | Lang | B21D 53/74 | 228/142 |
| 3,762,344 | A * | 10/1973 | Chez | B65D 19/0026 | 108/57.29 |
| 3,964,404 | A * | 6/1976 | Mueller | A47B 57/265 | D25/1 |
| 4,138,953 | A * | 2/1979 | Tashman | A47B 57/265 | 248/188 |
| 4,257,333 | A * | 3/1981 | Pollack | A47B 57/265 | 108/62 |
| 4,444,125 | A * | 4/1984 | Welsch | A47B 13/021 | 248/188 |

(Continued)

*Primary Examiner* — Devin K Barnett

(57) ABSTRACT

A storage shelf has a storage board with a storage frame. The storage frame has a plurality of ring sockets, a frame member and a steel plate. The frame member has a plurality of frame member units configured for assembly into a rectangular shape. Each frame member unit further has an edge wing lower than a top surface of the frame member unit. Each frame member unit further has a plurality of rib grooves. A plurality of combining pieces are attached and welded on inner surfaces of the frame member units to combined the plurality of frame member units. The frame member further has a plurality of ring grooves for engaging with the ring sockets, and each frame member unit further has a bottom surface. The steel plate is capable of being welded onto the edge wings or a top of the frame member to complete the storage frame.

10 Claims, 12 Drawing Sheets

(56) References Cited

U.S. PATENT DOCUMENTS 5,415,302 A * 5/1995 Carlson ..... A47B 57/265 211/187
5,927,893 A * 7/1999 Imamura ..... B62D 33/06 296/205
5,957,060 A * 9/1999 Rosenband ..... A47B 57/22 211/187
6,725,785 B2 * 4/2004 Wang ..... A47B 13/08 108/90
D634,570 S * 3/2011 Lin ..... D6/705
8,616,138 B1 * 12/2013 Fu ..... A47B 57/545 211/187
9,386,855 B2 * 7/2016 Sabounjian ..... A47B 96/14
9,854,906 B1 * 1/2018 Ke ..... A47B 47/0083
10,470,565 B1 * 11/2019 Levi ..... A47F 5/103
11,096,486 B1 * 8/2021 Ke ..... A47B 57/34
11,337,522 B2 * 5/2022 Cao ..... A47B 96/021
11,576,489 B1 * 2/2023 Ke ..... A47B 96/02
D1,075,380 S * 5/2025 Cheng ..... D6/705.6
2009/0250572 A1 * 10/2009 Cheng ..... A47B 47/0008 248/188.6
2016/0120313 A1 * 5/2016 Tang ..... A47B 47/0091 211/134
2017/0197647 A1 * 7/2017 Bouma ..... B62B 3/006
2018/0372136 A1 * 12/2018 Cheng ..... A47B 96/024
2019/0126412 A1 * 5/2019 Cheng ..... B23K 20/22
2021/0259412 A1 * 8/2021 Aulbach ..... F25D 25/02
2023/0122809 A1 * 4/2023 McMillin ..... F25D 25/02 312/223.5
2023/0276944 A1 * 9/2023 Orozco Aguayo .. A47B 96/061

* cited by examiner

A-A

B-B

STORAGE SHELF

BACKGROUND OF THE INVENTION

Field of Invention

The present invention relates to a storage shelf.

Description of the Related Art

In the conventional structure of the storage board, most of the storage boards are mostly a grid layer, in order to enhance the structure of the storage board and allow to accept a solid board for easy storage, and to hide the sharp edge of the grid layer to prevent being cut by the edges, as shown in FIGS. 9 and 10, a frame edge 90 is added on the edge of the storage board. The frame edge 90 is composed of several edge wings 91, the edge wing 91 has several corresponding convex portions 92 or grooves 93 on the side of the edge wing 91, and the corresponding convex portions 92 are embedded in the grooves 93 and then welded to help the edge wing 91 to be combined with each other. When the frame edge 90 is placed on the edge of the storage board, the effect of edge sealing and edge wrapping can be achieved, and the frame edge 90 can be used to enhance the structure and place the solid board.

However, the conventional storage board structure also has the following problems: it is difficult to control the gap between the edge wings 91 of the frame with the convex portion 92 is engaged in the mating groove 93, and it is not only difficult to weld, but also affects its performance. The quality of the welding connection also makes the weld marks quite obvious on the surface, which has a negative impact on the combination and use of the frame edge 90 and also affects its appearance.

Therefore, the shelf structure is used to carry items for storage, and it is necessary to pay more attention to the stability of the shelf. The shelf may be damaged due to carrying excessive weight, or disasters such as earthquakes may cause the shelf to disintegrate, thereby causing damage to property damage, so it is necessary to improve the structural stability of the shelf structure.

Therefore, it is desirable to provide a storage shelf structure to mitigate and/or obviate the aforementioned problems.

SUMMARY OF THE INVENTION

An objective of present invention is to provide a storage shelf structure, which is capable of improving the above-mention problems.

In order to achieve the above-mentioned objective, a storage shelf has a storage board with a storage frame. The storage frame has a plurality of ring sockets, a frame member and a steel plate. The frame member has a plurality of frame member units configured for assembly into a rectangular shape. Each frame member unit further has an edge wing lower than a top surface of the frame member unit. Each frame member unit further has a plurality of rib grooves. A plurality of combining pieces are attached and welded on inner surfaces of the frame member units to combined the plurality of frame member units. The frame member further has a plurality of ring grooves for engaging with the ring sockets, and each frame member unit further has a bottom surface. The steel plate is capable of being welded onto the edge wings or a top of the frame member to complete the storage frame.

Other objects, advantages, and novel features of invention will become more apparent from the following detailed description when taken in conjunction with the accompanying drawings.

DETAILED DESCRIPTION OF PREFERRED EMBODIMENT

Figure 1:
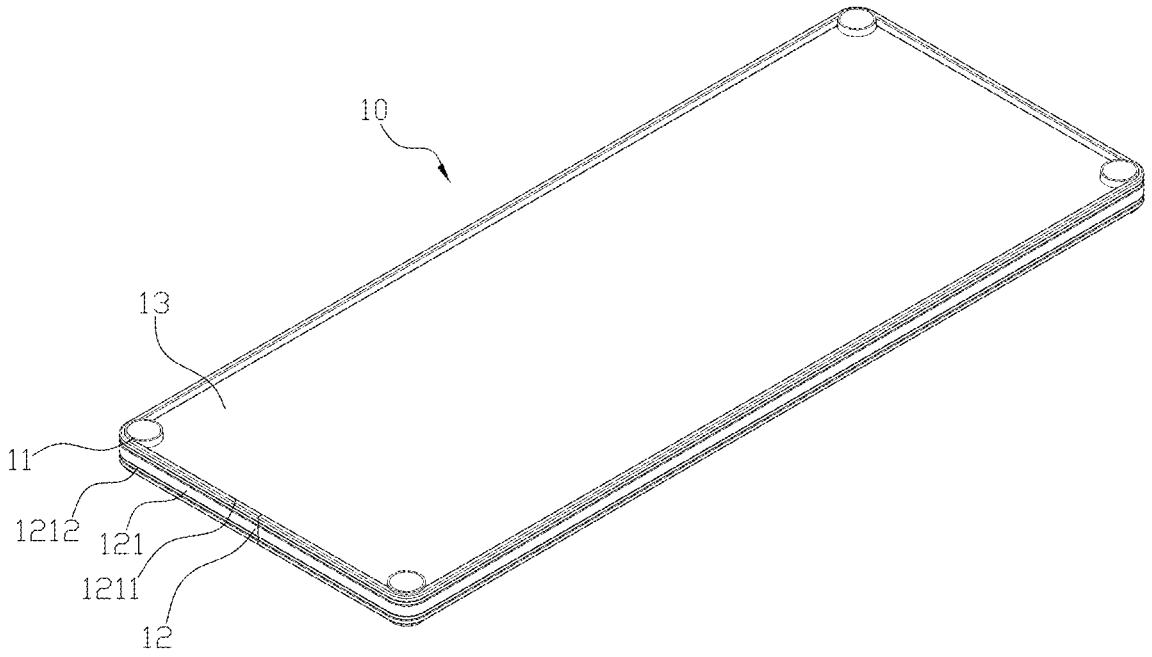
FIG. 1 is a perspective view of a preferred embodiment according to the present invention.
Figure 2:
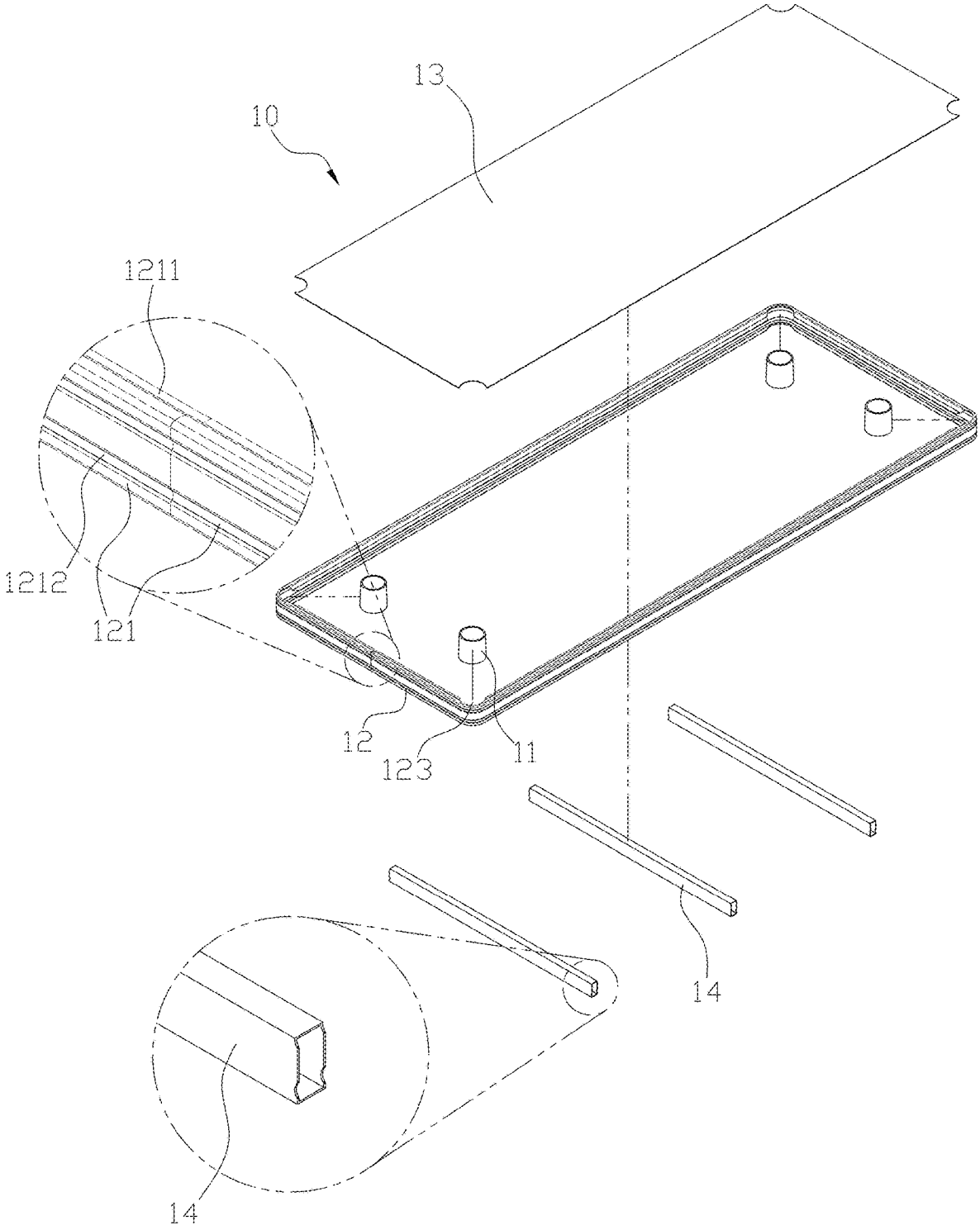
FIG. 2 is an exploded view of the preferred embodiment according to the present invention.
Figure 3:
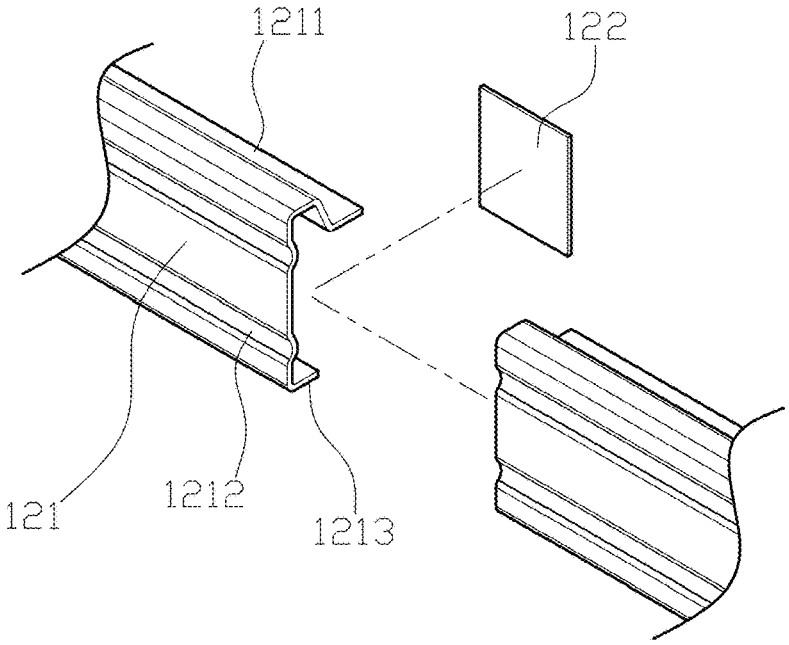
FIG. 3 is a schematic diagram of the combination of the framing member units of a first embodiment according to the present invention.
Figure 4:
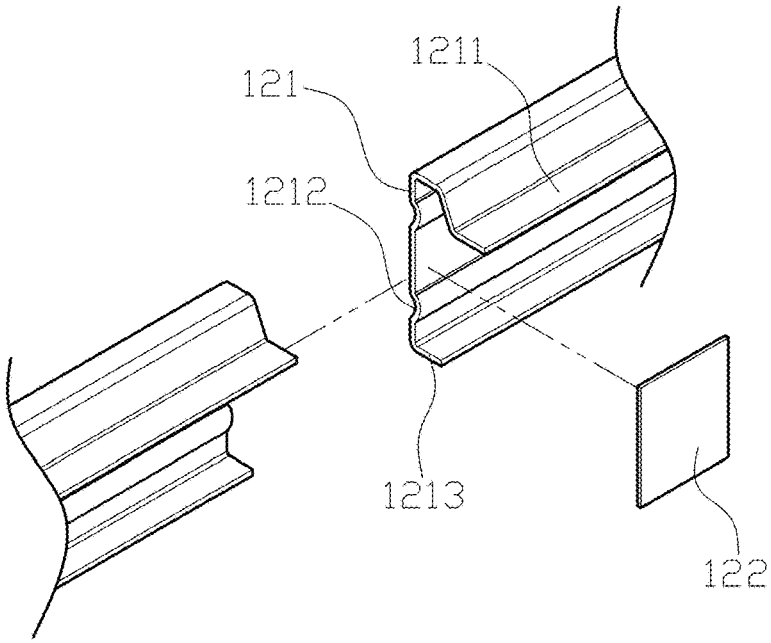
FIG. 4 is another schematic diagram of the framing member unit of the first embodiment according to the present invention from another angle.
Figure 5:
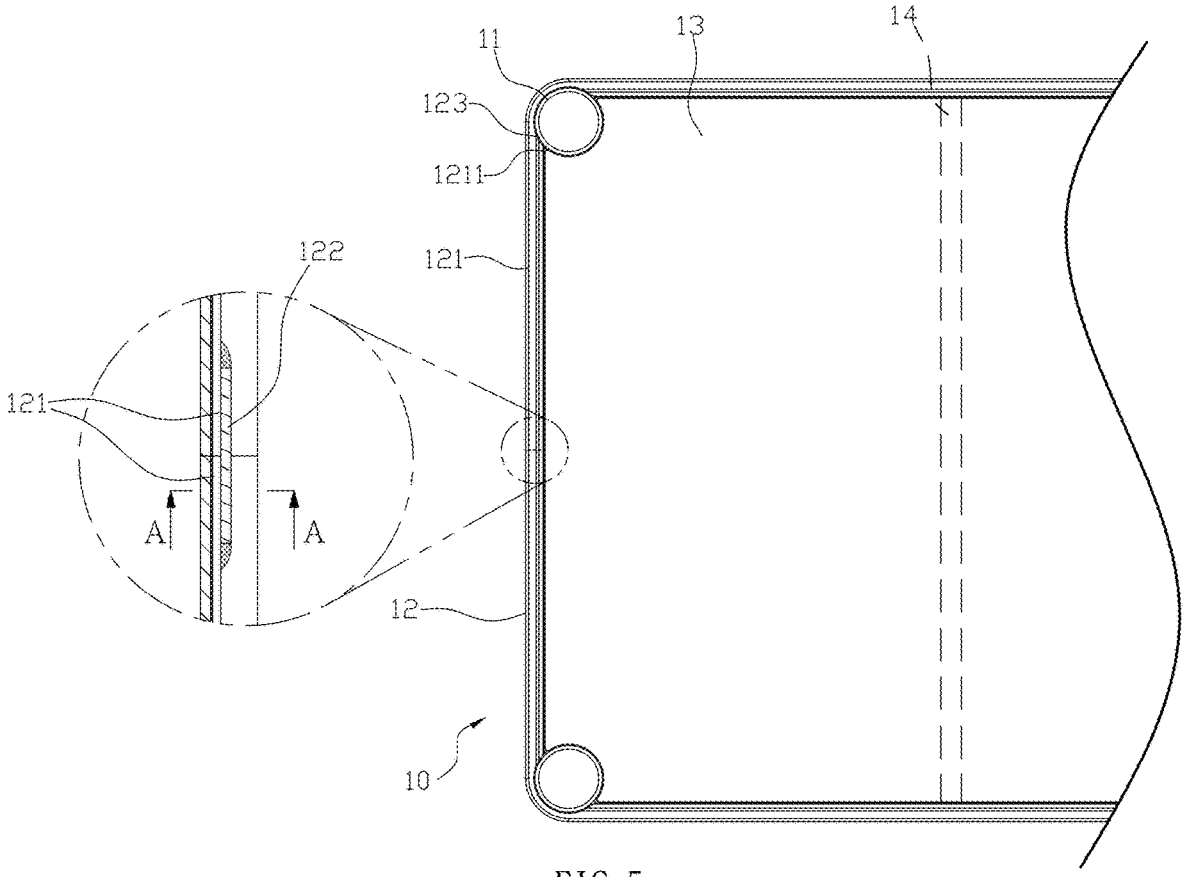
FIG. 5 is a top view of the first embodiment according to the present invention.

First, please refer to FIGS. 1-7. In a first embodiment of the present invention, a storage shelf comprises a storage frame 10, wherein the storage frame 10 has a plurality of ring sockets 11, a frame member 12 and a steel plate 13. The frame member 12 comprises a plurality of frame member units 121 configured for assembly into a rectangular shape. The frame member unit 121 further comprises an edge wing 1211 lower than a top surface of the frame member unit 121, and each frame member unit 121 further has a plurality of rib grooves 1212 grooves on a surface of the frame member unit 121. A plurality of the combining pieces 122 are attached and welded on inner surfaces of the frame member units 121 to combined the plurality of the frame member units 121. The frame member 12 comprises a plurality of ring grooves 123 for engaging with the ring socket 11, and each frame member unit 121 further has a bottom surface 1213. The steel plate 13 is capable of being welded onto the edge wings 1211 or a top of the frame member 12 to complete the storage frame 10.

Furthermore, the frame member 12 further comprises a plurality of reinforcement strips 14 disposed parallel with an edge of the storage frame 10 to enhance structural stability of the storage frame 10. A side face of each reinforcement strip 14 is capable of adhering onto an inner side of the frame member unit 121, and a top face or a bottom face of each reinforcement strip 14 is capable of being adhered onto the edge wings 1211 or the bottom surface 1213 of the frame member unit 121.

With the above structure, the frame member unit 121 is attached and welded to the inner surfaces of the two frame member units 121 via the combining pieces 122, thereby having a larger contact area for easy welding, so that the frame member units 121 are easier to be combined together. Also, the combining pieces 122 are hidden inside the frame member unit 121, making the surface of the frame member 12 smooth without welding marks, and the ring groove 123 is designed to snap on the ring socket 11 to ensure the assembly, which allows the storage frame 10 is relatively simple and convenient to manufacture and assemble.

Moreover, the steel plate 13 is a better material for heavier objects. The inner side of the frame member 12 is capable of being combined with the reinforcement strip 14 to increase the structural strength. In addition, the upper edge of the frame member unit 121 forms an edge wing 1211 inward with a height difference, and the presence of the rib groove 1212 also enhances the structure, which makes the storage frame 10 to be more stable and durable.

When using the steel plate 13, objects can be steadily place on the solid steel plate 13, and the ring socket 11 can be jacketed onto the pole, thereby utilizing multiple storage frames 10 for storage at different heights. Furthermore, since the edge wing 1211 is lower than the top surface of the frame member unit 121, the steel plate 13 can be placed more easily without displacement.

Figure 6:
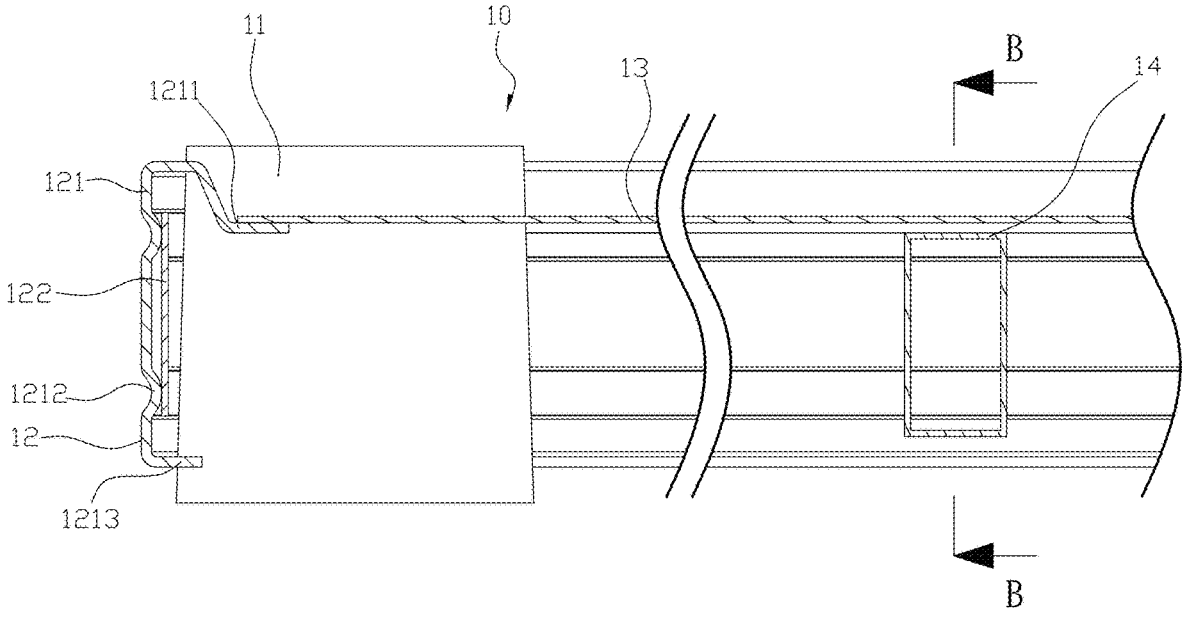
FIG. 6 is a A-A line cross-sectional view in FIG. 5 of the first embodiment according to the present invention.
Figure 7:
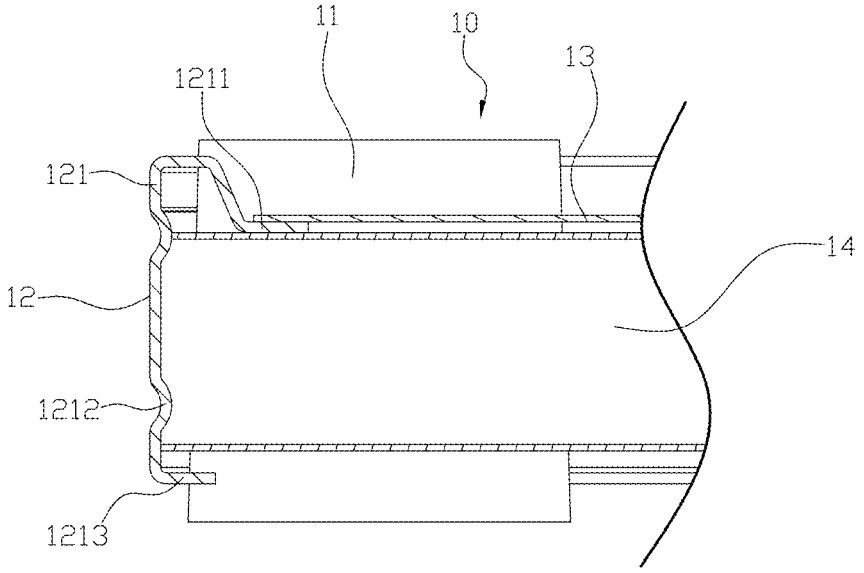
FIG. 7 is a B-B line cross-sectional view in FIG. 6 of the first embodiment according to the present invention.

As shown in FIG. 6, the combining pieces 122 are flat and welded onto only inner surfaces of the rib grooves 1212.

Figure 8:
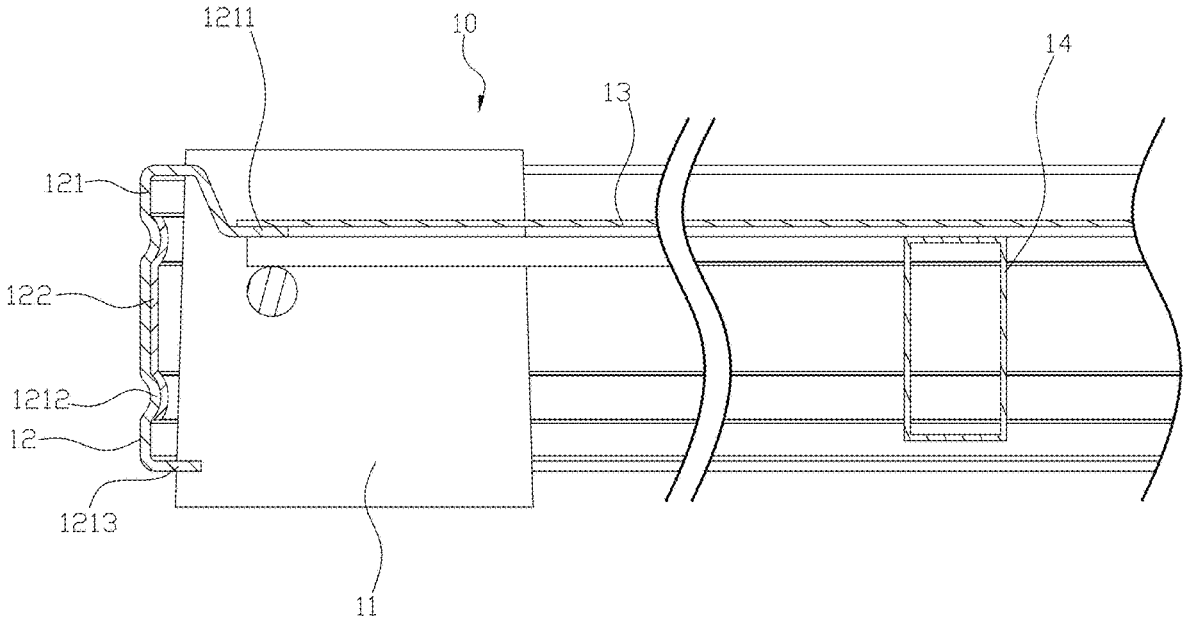
FIG. 8 is a schematic diagram of a cross-section front view of a second embodiment according to the present invention.

As shown in FIG. 8, the combining piece 122 are curved corresponding to the rib grooves 1212, and the combining pieces 122 are capable of attaching onto the frame member unit 121 and the rib grooves 1212.

Figure 9:
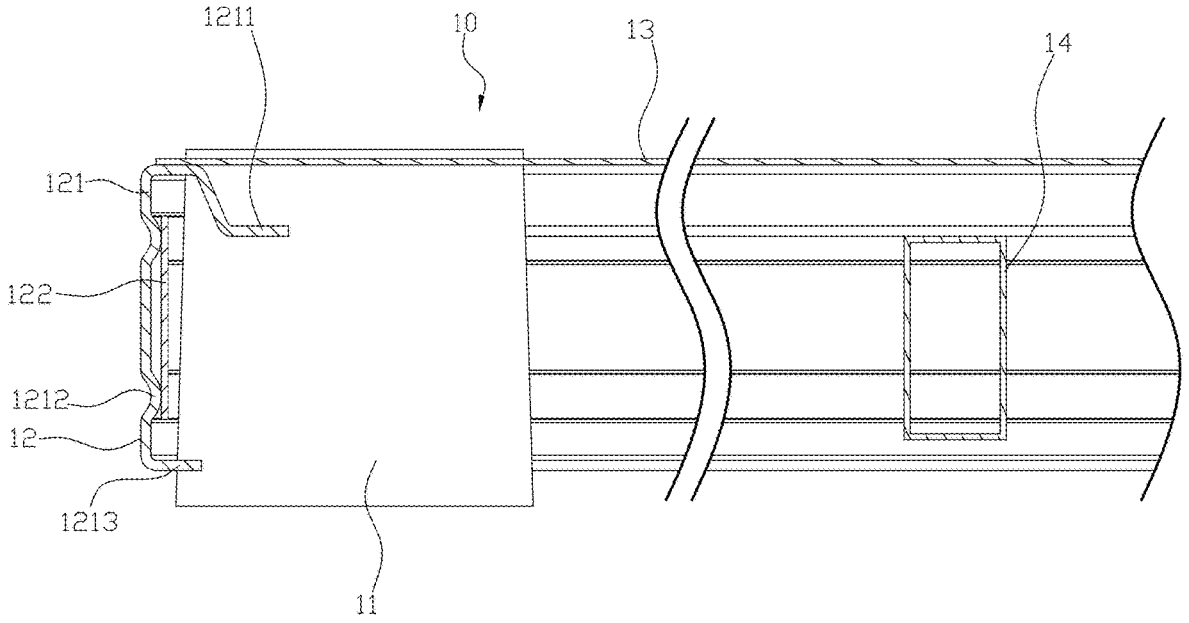
FIG. 9 is a cross-section front view of a third embodiment according to the present invention.

As shown in FIG. 9, the steel plate 13 is placed on the top of the frame member 12.

Figure 10:
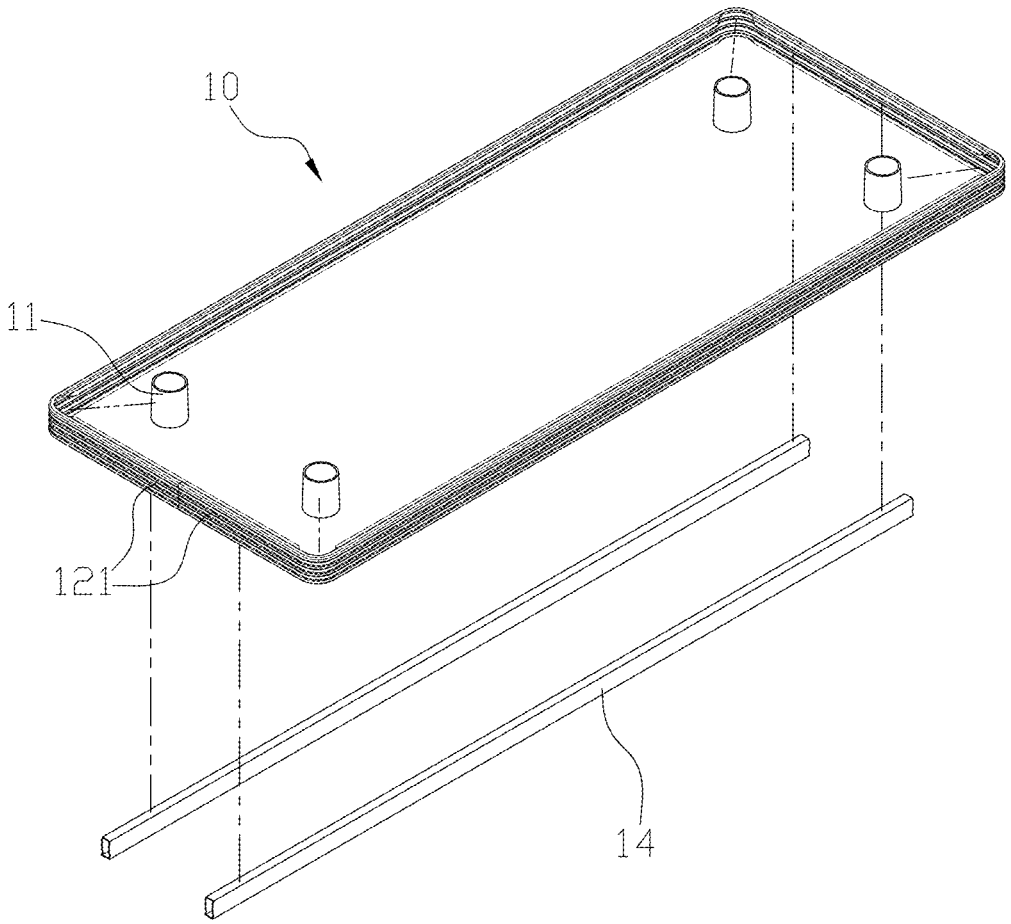
FIG. 10 is an exploded view of the fourth embodiment according to the present invention.
Figure 11:
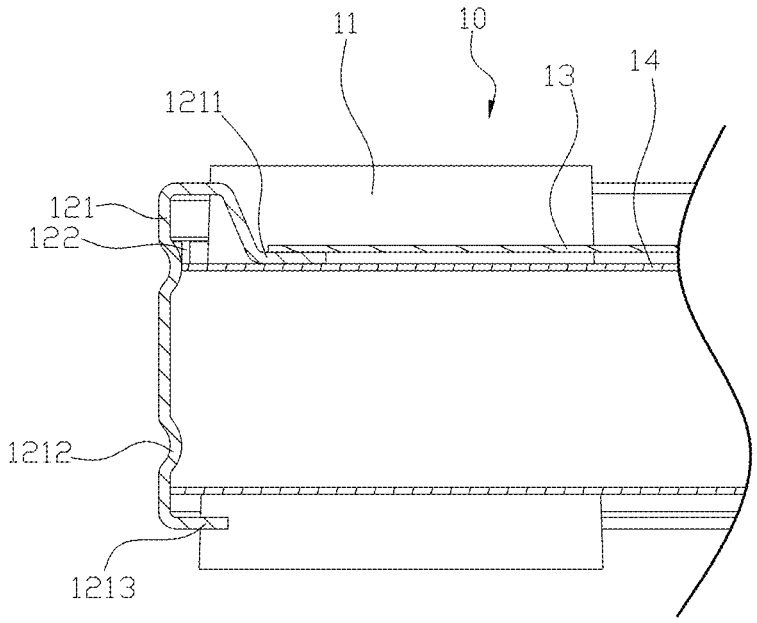
FIG. 11 is a cross-section front view of a third embodiment according to the present invention
Figure 12A:
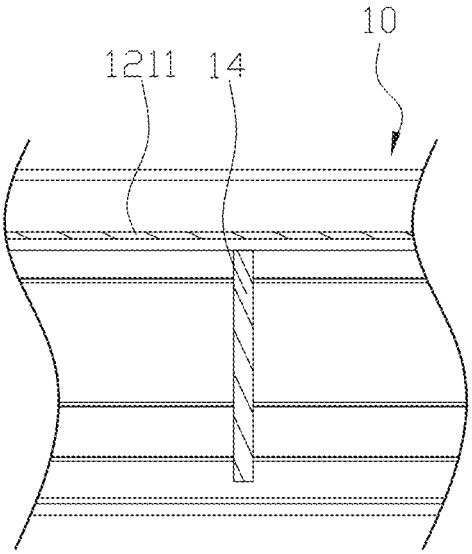
FIGS. 12*a*-12*d* are schematic drawings showing different designs of the reinforcement strip according to the present invention.
Figure 12B:
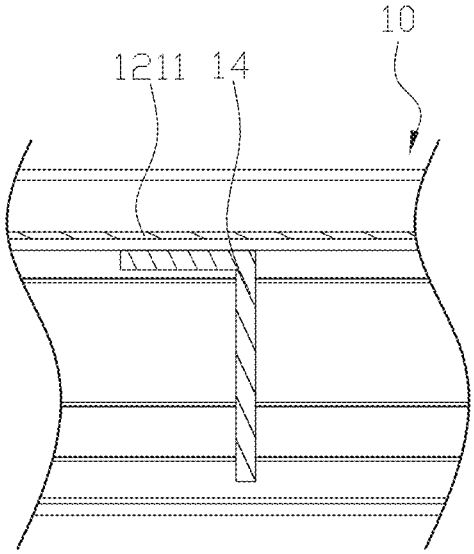
Figure 12C:
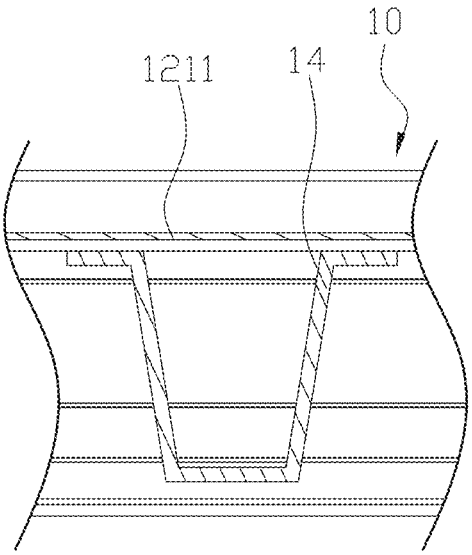
Figure 12D:
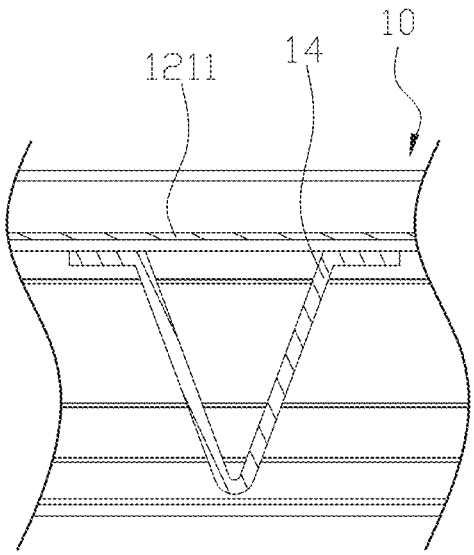
Figure 13:
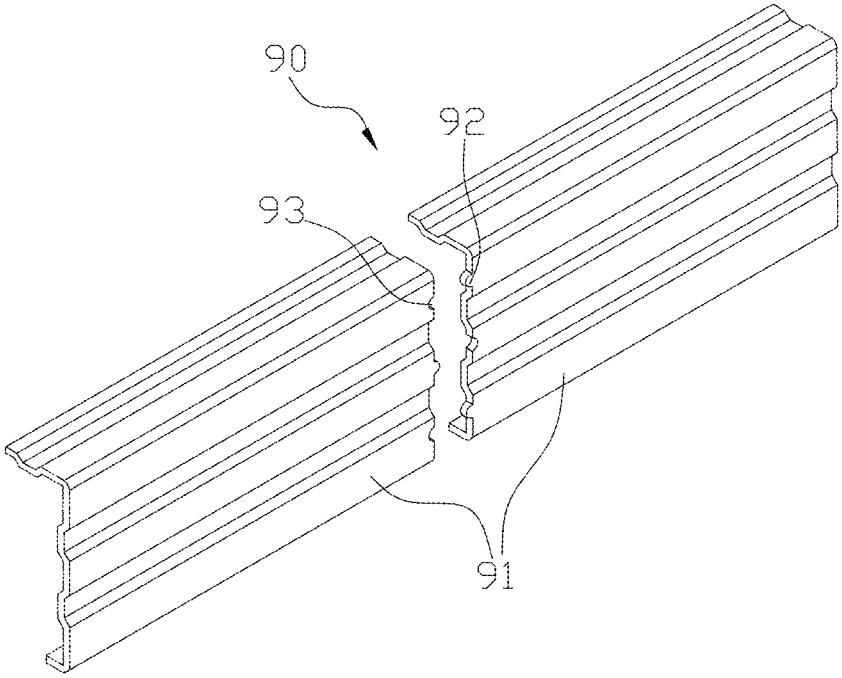
FIG. 13 PRIOR ART
FIG. 13 is a schematic drawing of the conventional storage frames before being combined.
Figure 14:
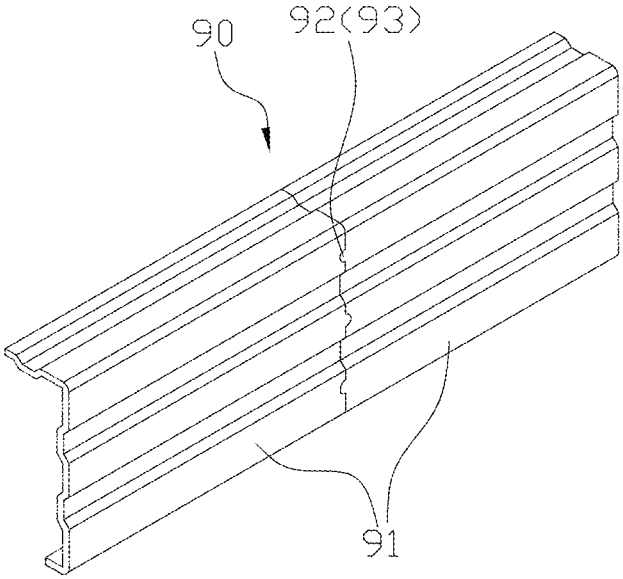
FIG. 14 PRIOR ART
FIG. 14 is a schematic drawing the conventional storage frames after being combined.

As shown in FIGS. 1 to 9, the reinforcement strips 14 are attached onto the inner side of the frame member 12 in a direction parallel with a short edge of the storage frame 10. Alternatively, as shown in FIGS. 10 and 11, the reinforcement strips 14 are attached onto the inner side of the frame member 12 in a direction parallel with a long edge of the storage frame 10.

Additionally, the combining pieces 122 are welded onto the inner surface of the frame member unit 121.

As shown in FIGS. 1 to 9, a cross-section of each reinforcement strip 14 has a U shape. As shown in FIG. 12, the reinforcement strips 14 are flat or have an L shaped cross-section, an open trapezoidal shape or a V shape.

Also, there are four ring sockets 11 corresponding to the four corners of the frame member 12.

Although the present invention has been explained in relation to its preferred embodiment, it is to be understood that many other possible modifications and variations can be made without departing from the spirit and scope of invention as hereinafter claimed.

What is claimed is:

1. A storage shelf comprising:

a storage frame, and a steel plate, the storage frame comprising:

a plurality of ring sockets, and a frame member;

wherein the frame member comprises a plurality of frame member units configured for assembly into a rectangular shape, each frame member unit comprising an edge wing lower than a top surface of the frame member unit;

wherein each frame member unit further comprises a plurality of rib grooves on a surface of the frame member unit;

a plurality of combining pieces attached onto inner surfaces of the frame member units to combine the plurality of frame member units;

wherein the frame member further comprises a plurality of ring grooves for engaging with the ring sockets, and each frame member unit further comprises a bottom surface; and the steel plate is capable of being attached onto tops of the edge wings or the top surfaces of the frame member units to complete the storage frame;

wherein for each frame member unit, the edge wing is vertically positioned between the top surface and the bottom surface and horizontally extends beyond the bottom surface.

2. The storage shelf as claimed in claim 1, wherein the frame member further comprises a plurality of reinforcement strips disposed parallel with an edge of the storage frame to enhance structural stability of the storage frame, a side face of each reinforcement strip being capable of attaching onto an inner side of a respective frame member unit, and a top face or a bottom face of each reinforcement strip is capable of being attached onto the edge wings.

3. The storage shelf as claimed in claim 2, wherein the reinforcement strips are attached onto the inner sides of the frame member units in a direction parallel with a short edge of the storage frame.

4. The storage shelf as claimed in claim 2, wherein the reinforcement strips are attached onto the inner sides of the frame member units in a direction parallel with a long edge of the storage frame.

5. The storage shelf as claimed in claim 2, wherein a cross-section of each reinforcement strip has a U shape.

6. The storage shelf as claimed in claim 2, wherein the reinforcement strips are flat or have an L shaped cross-section, an open trapezoidal shape, or a V shape.

7. The storage shelf as claimed in claim 2, wherein the combining pieces are flat and welded onto only inner surfaces of the rib grooves.

8. The storage shelf as claimed in claim 2, wherein the combining pieces are curved corresponding to the rib grooves, and the combining pieces are capable of attaching onto the frame member unit and the rib grooves.

9. The storage shelf as claimed in claim 2, wherein the combining pieces are welded onto the inner surfaces of the frame member units.

10. The storage shelf as claimed in claim 1, comprising four ring sockets.

* * * * *